US005702046A

United States Patent [19]

Rokita et al.

[11] Patent Number: 5,702,046

[45] Date of Patent: Dec. 30, 1997

[54] STAPLE GUN HAVING A ROTATING LOWER HOUSING

[75] Inventors: Stephen R. Rokita, Sussex; John J. Davis, Little Falls, both of N.J.

[73] Assignee: Rokey Corporation, Sussex, N.J.

[21] Appl. No.: 457,425

[22] Filed: Jun. 1, 1995

[51] Int. Cl.[6] ..... B25C 5/02

[52] U.S. Cl. ..... 227/110; 227/132

[58] Field of Search ..... 29/432; 227/132, 227/156, 146, 148, 143, 110, 111

[56] References Cited

U.S. PATENT DOCUMENTS 2,358,463 9/1944 Masters ..... 227/110
2,922,163 1/1960 Smick ..... 227/110
3,451,606 6/1969 Jacobson ..... 227/110
4,801,062 1/1989 Austin .
4,903,880 2/1990 Austin et al. .

*Primary Examiner*—David P. Bryant
*Attorney, Agent, or Firm*—Glen M. Diehl

[57] ABSTRACT

A staple gun having a rotating lower housing is disclosed. The staple gun has top and lower housings that include a cylindrical section. A cylindrical driver mechanism is housed in the cylindrical sections of the top and lower housings. The lower housing preferably includes a staple magazine. When using the staple gun, the lower housing, the staples in the staple magazine and the driver mechanism rotate together allowing the operation of the staple gun at a plurality of angles.

6 Claims, 5 Drawing Sheets

STAPLE GUN HAVING A ROTATING LOWER HOUSING

BACKGROUND OF THE INVENTION

The present invention relates to stapling and to staple guns. More specifically, it relates to the driver mechanisms and the housings of the staple guns.

Today's staple guns typically consist of a housing in which a driver mechanism moves to drive a staple into an object when a triggering mechanism is activated. The driver mechanism moves along a single axis within the housing and in a fixed orientation relative to the housing to drive staples into an object. The staples are spring fed in a staple magazine into a fixed position relative to the housing. Typical of these staple guns is the Model T-50 sold by Arrow.

When a person uses these staple guns, the housing of the gun must be manipulated into the proper position relative to the object being stapled to effectively drive the staple into the object. In many cases, this is not always easy or even possible. For example, when a cable installer climbs a ladder to staple a cable in place, the installer is often not easily positioned to properly use the staple gun. In these cases, the installer will often get into a dangerous position to use the staple gun.

In view of this and other limitations of existing staple guns, new and improved staple guns are needed.

SUMMARY OF THE INVENTION

In accordance with the present invention, a staple gun which can drive staples into objects at variable angles relative to a top housing of the staple gun is provided. The staple gun preferably includes a top housing, a driver mechanism, a trigger mechanism for activating the driver mechanism and a lower housing. The lower housing preferably includes a staple magazine and is connected to the top housing so that it rotates around the top housing. Stated another way, the lower housing rotates around the axis of movement by the driver mechanism. The rotation of the lower housing causes the rotation of the driver mechanism and the staples so that the staples can be driven into the object at a plurality of angular positions.

The staple magazine can be rotated to one of a plurality of positions relative to the housing. In a preferred embodiment, the positions are 0°, 90°, 180°, and 270° relative to the housing. If desired, many other positions can be provided. In fact, the lower housing can be rotated a full 360°.

In accordance with a preferred embodiment of the present invention, the lower housing also has a cylindrical section that fits inside a cylindrical section of the top housing. The driver mechanism has a cylindrical section which fits inside the cylindrical sections of the housings. The driver mechanism also includes a cylindrical position locking mechanism, a center bar and a bottom retainer. A part of the position locking mechanism is secured to the top housing and the bottom retainer is secured to the lower housing, thus securing the lower housing to the top housing. The position locking mechanism includes two parts that can be rotated relative to each other that allows the staple magazine to be rotated about the housing. In an alternate embodiment, the cylindrical sections of the housing and of the staple magazine are ribbed in matching locations so that the lower housing is held in place in the top housing.

In accordance with another aspect of the present invention, the length of the lower housing is shorter than the length of the top housing. The top housing includes a base section that extends downward. When the lower housing is rotated relative to the top housing, the object in which the staple is to be driven is contacted by the base section of the top housing and by a portion of the lower housing to provide stable operation of the staple gun.

The driver mechanism of the present invention preferably includes a plurality of apertures which are engaged by the trigger mechanism when the trigger mechanism is activated. The apertures are provided at each angular location that the lower housing can be rotated to. The staple gun also preferably includes position locking means that lock the lower housing in position relative to the top housing so that the apertures operatively mate with the trigger mechanism at defined angles. Alternatively, the driver mechanism has a lip around at least part of its circumference and the lip is engaged by the trigger mechanism when the trigger mechanism is activated.

The invention will now be further described in connection with certain illustrated embodiments; however, it should be clear to those skilled in the art that various modifications, additions and subtractions can be made without departing from the spirit and scope of the claims.

DESCRIPTION OF THE PREFERRED EMBODIMENT

Figure 1:
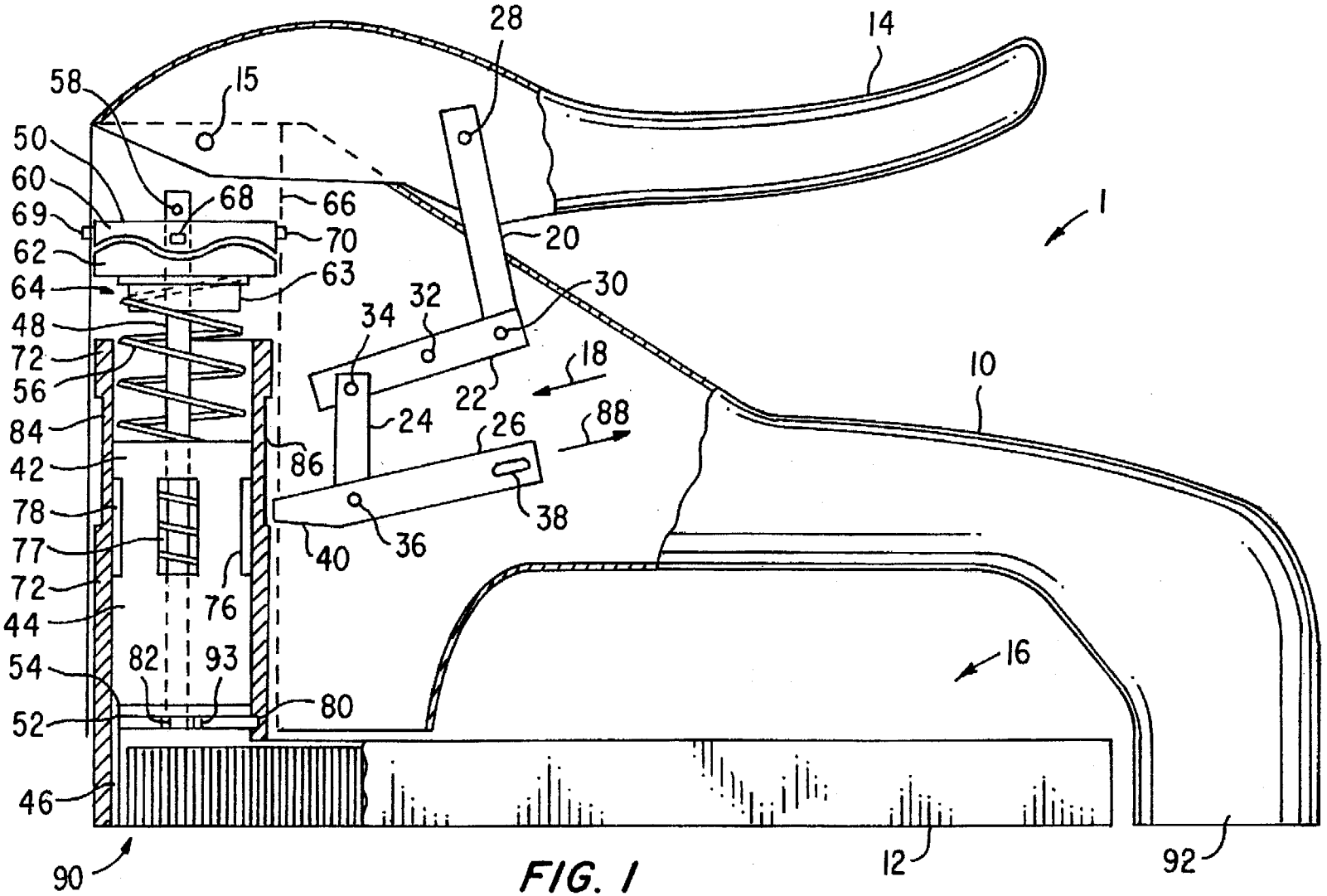
FIG. 1 illustrates a side view of a staple gun in accordance with a preferred embodiment of the present invention.

A side view of a staple gun 1 in accordance with one aspect of the present invention is illustrated in FIG. 1. The staple gun includes a top housing 10 and a lower housing 12. The lower housing 12 preferably includes a staple magazine of conventional design. The top housing 10, for the most part, is also of a conventional design. For example, the housing of the Model T-50 stapler, made by Arrow, with some modifications that will be discussed, can be utilized.

A lever 14 is attached to the top housing 10 via a hinge 15 and the top housing 10 preferably includes an open section 16 through which the fingers of the staple gun operator can fit in order grasp the staple gun 1. The handle 14 is operably attached to a triggering mechanism 18 which is supported inside the housing 10. The triggering mechanism 18 is also, for the most part, of a conventional design. The triggering mechanism used in Arrow's Model T-50, with a few modifications that will be discussed shortly, is a preferred triggering mechanism for use in the present invention, although other triggering mechanisms can readily be used.

The triggering mechanism 18 includes a first section 20, a second section 22, a third section 24 and a lever section 26. A first end of the first section 20 is attached to the handle 14 via a hinge 28. A second end of the first section is attached to a first end of the second section 22 via a hinge 30. The middle of the second section 22 is attached to the top housing 10 via a hinge 32. A second end of the second section 22 is attached to a first end of the third section 24 via a hinge 34. A second end of the third section 24 is attached to the lever section 26 via a hinge 36. The lever section 26 is pivotally connected to the top housing 10 via a hinge 38.

When the lever 14 is depressed by a staple gun operator, the first section 20 and the first end of the second section 22 are moved downward, causing the second section 22 to pivot about the hinge 32. This raises the second end of the second section 22, the third section 24 to cause the lever section 26 to pivot upward about the hinge 38.

The lever section 26 includes a pronged end 40. In the triggering mechanism of the Model T-50, there are two prongs that extend forward and slightly outward to engage a driver mechanism. In accordance with a preferred embodiment of the present invention, the prongs from the Model T-50 triggering mechanism are modified so that they extend inward to engage the driver mechanism. This modification of the Model T-50 trigger. mechanism is desired because the trigger mechanism 18 used in the present invention engages a cylindrical driver mechanism 42 whereas the Model T-50 uses a squared driver mechanism. Thus, to provide secure engagement between the trigger mechanism 18 and a cylindrical driver mechanism 42, the prongs 40 are extended inward.

The driver mechanism 42 preferably includes a cylindrical section 44, a hammer section 46, a center driveshaft/link 48, a position locking mechanism 50, a bottom retainer 52, a shock absorbing pad 54, a spring 56, and a retaining pin 58. The position locking mechanism 50 preferably consists of a top part 60 and a bottom part 62. The spring 56 is preferably guided by a guide 63 which extends from the bottom part 62 and the spring 56 runs down to the bottom of the cylindrical driver mechanism 42, which is either solid or lipped to provide support for the spring 56. The center driveshaft/link 48 runs down the center axis of the driver mechanism 42. The center driveshaft/link 48 is preferably engaged to the bottom part 62 and the bottom retainer 52 so that these parts rotate together. The bottom retainer 52 is secured to the lower housing 12. Thus, when the lower housing 12 turns or rotates relative to the top housing 10, the bottom part 62, the bottom retainer 52 and the center driveshaft/link 48 all rotate together with the lower housing 12. This can be accomplished by squaring or splining the center driveshaft/link 48 and shaping the center hole in the bottom part 62 and the bottom retainer 52 accordingly.

The top part 60, on the other hand, is secured to the top housing 10. More particularly, the top housing 10 includes a cylindrical section 64, as indicated by the dotted line 66. It is preferred to secure the top part 60 to the top housing 10 by means of tabs 68 to 70, using as many are needed to provide a secure fastening, keeping in mind the hammering action that will take place when the staple gun 1 is operated. The tabs 68 to 70 are preferably an integral part of the top part 60. Also, it is preferred to locate the tabs 68 to 70 so that the lever 14 does not impinge on the tabs when depressed. Further, the hole in the center of the top part 60 through which the center driveshaft 48 fits is shaped to allow the center driveshaft 48 to rotate without rotating the top part 60. This can be accomplished by making the center hole of the top part 60 and the area of the center bar 68 that meets the center hole of the top part 60 round to allow for the rotation.

In FIG. 1, the top part 60 and the bottom part 62 have faces that are shaped so that they lock together every time the bottom part 62 is rotated 90° relative to the top part 60. The interface between the top part 60 and the bottom part 62 is illustrated as being rounded to allow easier rotation. The arrangement of FIG. 1 allows the lower housing 12 to be rotated in 90° increments relative to the top housing 10. If more positions are desired, the shapes of the top and bottom parts 60 and 62 could be modified accordingly. Also, the interfacing faces of the top and bottom parts 60 and 62 could be triangular. In fact, they could be geared to allow the rotation of the lower housing 12 into many positions relative to the top housing 10.

The lower housing 12 includes a cylindrical section 72 that extends and fits into the cylindrical section 64 of the top housing 10. It is preferred that this fit be snug to provide rigidity and stability to the structure, but not so snug that the rotation of the lower housing 12 about the housing will be impeded. The cylindrical section 44 of the driver mechanism 42 preferably fits inside the cylindrical section 72 of the staple magazine 12. The bottom retainer 52 is secured to the cylindrical section 72 of the lower housing 12 by tabs 80 and 82, using as many tabs as needed to provide a secure fit.

When the handle 14 is not depressed, the driver mechanism 42 is held in the position shown, held in place by the pressure exerted by the spring 56 and the bottom retainer 52. In accordance with a preferred embodiment of the present invention, the driver mechanism 42 has a plurality of apertures in the cylindrical section 44. Three apertures 76 to 78 are illustrated. A fourth aperture, not shown, is on the opposite side of the cylindrical section 44 of the driver mechanism 42. As will be described, the use of four apertures allows stapling to be performed at four angles relative to the housing 10. Similar apertures (apertures 84 and 86 are shown in FIG. 1 ), spaced at 90°, are provided in the cylindrical section 72 of the lower housing 12, except the apertures in the cylindrical section 72 extend higher than the apertures in the cylindrical section 44 of the driver mechanism 42 to allow the driver mechanism 42 to be vertically raised in the cylindrical section 72.

In conjunction with the apertures, it should be noted that the position locking mechanisms 60 and 62 provide for rotations of 90°, as previously discussed. The positions of rotation provided by the position locking mechanism should match the locations of the apertures in both the driver mechanism 42 and the cylindrical section 72 of the lower housing 12. Thus, if different angles of rotation are desired, then the apertures in the driver mechanism 42 and in the cylindrical section 72 must be positioned accordingly and if more angles of rotation are desired, then more apertures in the driver mechanism 42 and in the cylindrical section 72 must be provided.

In addition to the apertures in the driver mechanism 42 and in the cylindrical section 72 of the staple magazine 12, the cylindrical section 64 in the top housing 10 preferably has a large aperture through which the pronged end 40 of the trigger mechanism 18 fits. This allows the pronged end to move upward when the trigger mechanism 18 is engaged.

When the handle 14 is activated by being depressed, as already discussed, the pronged end 40 of the lever section 26 pivots upward. Prior to this position, the prongs 40 are clear of the section 72 of the lower housing 12 to allow rotation of the lower housing 12. However, as the prongs 40 move upward, they contact the upper section of the aperture 76, or whichever aperture is positioned in front of the prongs 40, and begin to move the driver mechanism 42 upward. The trigger mechanism 18 is preferably constructed so that the lever section 26 moves backward slightly, along the line 88 indicated by the arrow in FIG. 1, as the lever section 26 pivots upward. This construction is used in the Model T-50 staple gun and permits the prong end 40 of the lever section 26 to maintain improved contact with the driver mechanism 42.

As driver mechanism 42 moves upward in the cylindrical section 48 of the housing 10, it compresses the spring 56. Eventually, the lever section 26 moves upward enough so that the prong end 40 loses contact with the aperture 76 in the driver mechanism 42 and the spring 56 causes the driver mechanism 42 to move downward. As the driver mechanism 42 moves downward, the hammer 46 moves downward along a fixed axis and strikes a staple which is held in place in the staple magazine in the lower housing 12 in a conventional manner. The staple is driven through the hole 90 in the bottom housing 12.

The top housing 10 of the staple gun 1 deviates from the conventional design of staple guns in one other important manner. The top housing 10 includes a base section 92. The length of the rotating lower housing 12 is preferably shorter than the length of the top housing 10. If the staples are being stapled at an angle other than 020 relative to the top housing 10—so that the lower housing 12 and the top housing 10 do not align—the base section 92 extends down so that the bottom of the base section 92 aligns with the bottom of the lower housing 12. Thus, the base section 92 and the cylindrical end of the lower housing 12 can contact the object being stapled so as to provide stability to the staple gun 1.

Accordingly, the arrangement of FIG. 1 permits the lower housing 12, which preferably includes a staple magazine, to be secured to the top housing 10 by means of the bottom retainer 82, the center driveshaft 48 and the top part 60 and yet be rotated about the top housing 10. The center driveshaft 48 is secured to the top part 60 by pin 58 or other means, such as a nut, and is secured to the bottom retainer by a pin 93 or by other means. The pin 58 or nut should be protected from the movement relative to the top part 60 by a washer and lubricant. While the staple gun 1 of FIG. 1 permits rotations in 90° increments, it will be appreciated that virtually any number of rotations at many different angles can be permitted.

Figure 2:
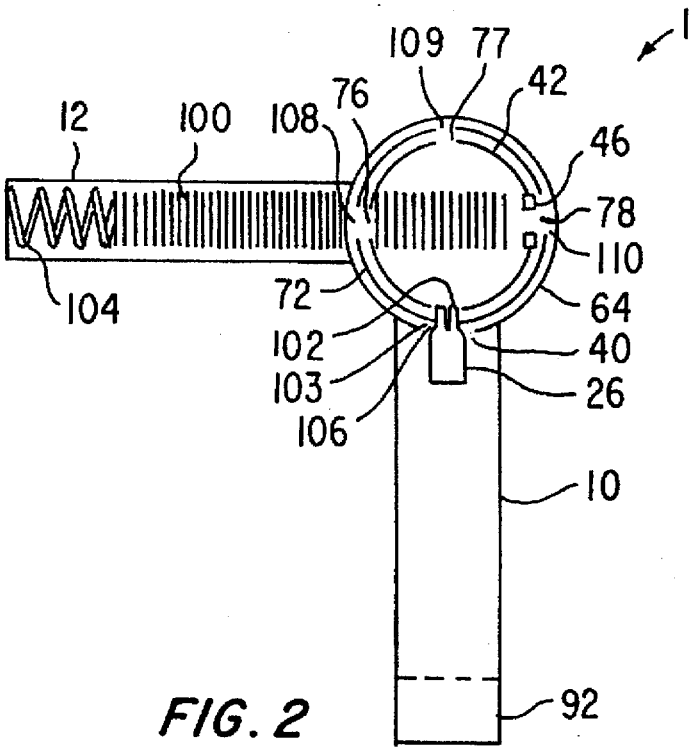
FIG. 2 illustrates a top view of the staple gun of FIG. 1.

Referring to FIG. 2, a top view of the staple gun 1 is illustrated. The lower housing 12 is illustrated being rotated at a 90° angle relative to the top housing 10. In this position, the rotation of the lower housing 12 caused the rotation of the cylindrical section 72 and the driver mechanism 42 relative to the cylindrical section 64 of the top housing 10. As a result, the staples 100 in the lower housing 12 and the hammer section 46 are oriented at a 90° angle relative to the top housing 10. The aperture 102 in the driver mechanism 42 and the aperture 103 in the cylindrical section 72 of the lower housing 12, which were not visible in FIG. 1, are now aligned with the pronged end 40 of the lever section 26 of the trigger mechanism 18. When the trigger mechanism 18 is activated, the driver mechanism 42 is raised, the staples 100 are fed into position under the hammer section 46 by a conventional spring feeding mechanism 104 and the driver mechanism 42 is dropped so that the hammer section 46 drives one of the staples into the object being stapled at an 90° angle relative to the top housing 10. Looking at the cylindrical section 64 of the top housing 10, the aperture 106 in the cylindrical section 64 allows the prong end 40 to protrude through the cylindrical section 64 of the housing 10 so that the aperture 102 can be engaged. Looking at the cylindrical section 72 of the staple magazine 12, it can be seen that the apertures 108 to 109 and 103 are provided opposite apertures 76 to 78 and 102, respectively, to allow the driver mechanism 42 to be engaged in any of the 90° angular positions. When the lower housing 12 is locked into position relative to the top housing 10 by the position locking mechanism 50 one of the apertures 76 to 78 or 102 in the driver mechanism 42, and one of the apertures 108 to 111, are aligned with the aperture 106 and the prong end 40 of the trigger mechanism 42, thus allowing the staples 100 to be driven at angles relative to the top housing 10.

Figure 3:
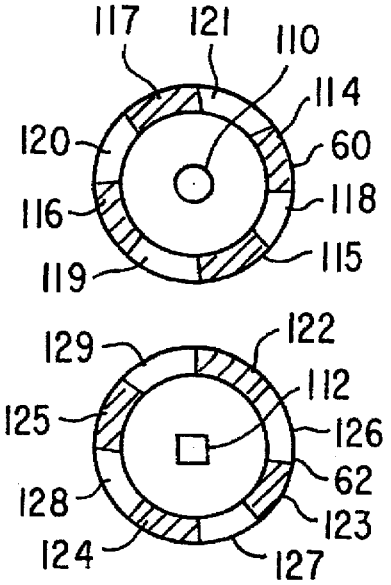
FIG. 3 illustrates the position locking mechanism used in FIG. 1.

Referring to FIG. 3, top and bottom views of the bottom part 62 and the top part 60, respectively, of the position locking mechanism 50 are illustrated. The hole 110 in the center of the top part 60 is round to allow the free rotation of the center driveshaft 48 when the lower housing 12 is rotated. It is preferred that the portion of the driveshaft 48 that interfaces with the top part 60 be round. The hole 112 in the center of the bottom part 62, however, is square, so that the square center driveshaft 48 causes the bottom part 62 to be rotated with the rotation of the center driveshaft 48 when the lower housing 12 is rotated.

In the top part 60, shaded areas 114 to 117 along the outer rim represent the raised areas on the top part 60 and non-shaded areas 118 to 121 represent the non-raised areas, or valleys, on the top part 60. In the bottom part 62, shaded areas 122 to 125 represent the raised areas on the top part 60 and non-shaded areas 126 to 129 represent the non-raised areas, or valleys, of the bottom part 62. When the raised areas 114 to 117 of the top part 60 align with the valleys 126 to 129 of the bottom part 62, the valleys 118 to 121 of the top part 60 align with the raised areas 122 to 125 of the bottom part 62. The spring 56 then pushes these aligned components together and locks the lower housing 12 into position. As mentioned previously, the raised areas and the valleys are preferably sloped to allow easier rotation of the lower housing 12. Also, more or less raised areas and valleys can be provided, depending on how many positions it is preferred to provide for the rotation of the lower housing 12.

Figure 4:
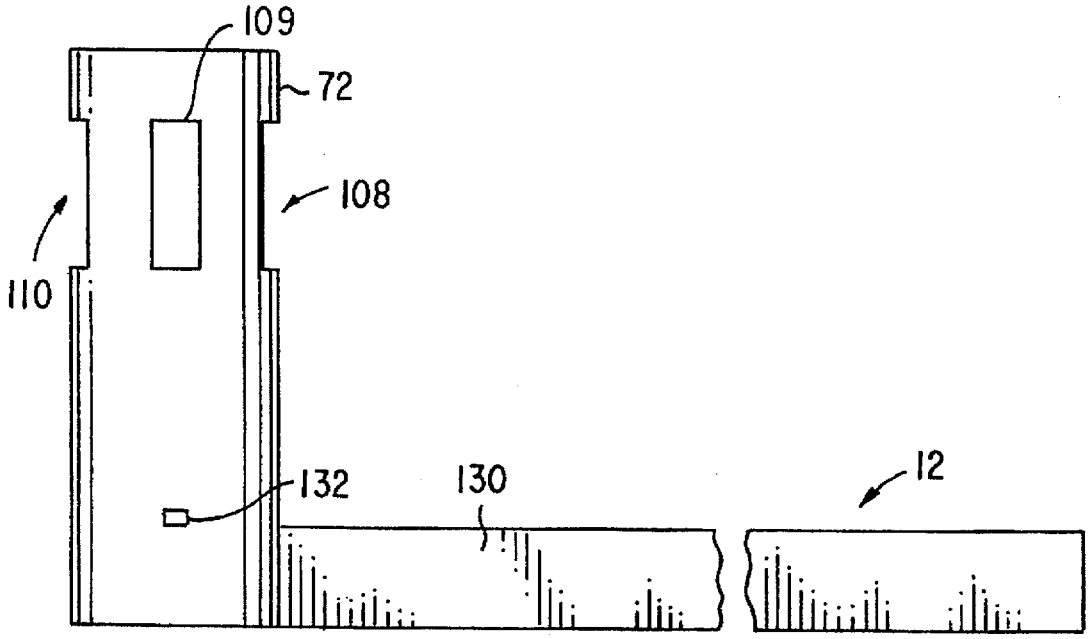
FIGS. 4 and 5 illustrate the bottom and top housings, respectively, of the staple gun of FIG. 1.

Referring to FIG. 4, a side view of the lower housing 12 is shown. The staple magazine 130 includes a conventional staple loading mechanism to properly position staples under the driver mechanism. A hole 132 is provided through which the tab 82 of the bottom retainer 52 fits to secure the bottom retainer 52 to the staple magazine 12. Of course, as many holes 132 as needed are provided in the staple magazine 12. The apertures 108 to 110 in the cylindrical section 72 are illustrated more clearly in FIG. 4. As explained before, there are four apertures that are spread by 90° intervals, with one of the apertures being located behind the aperture 109 and not visible in FIG. 4.

Figure 5A:
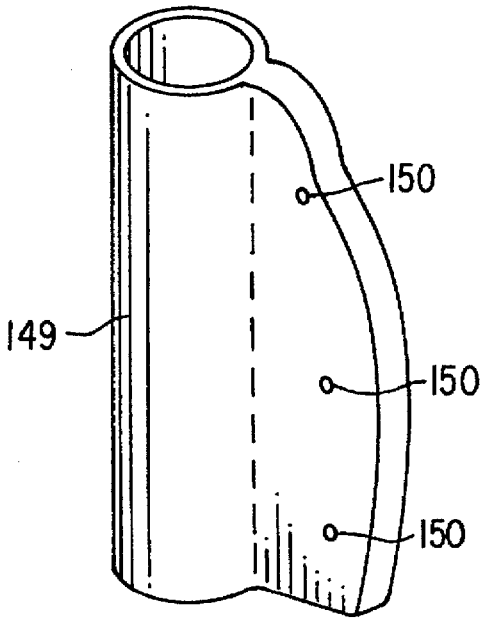
FIG. 5A illustrates a retainer sleeve for the top housing of the staple gun of the present invention.
Figure 5:
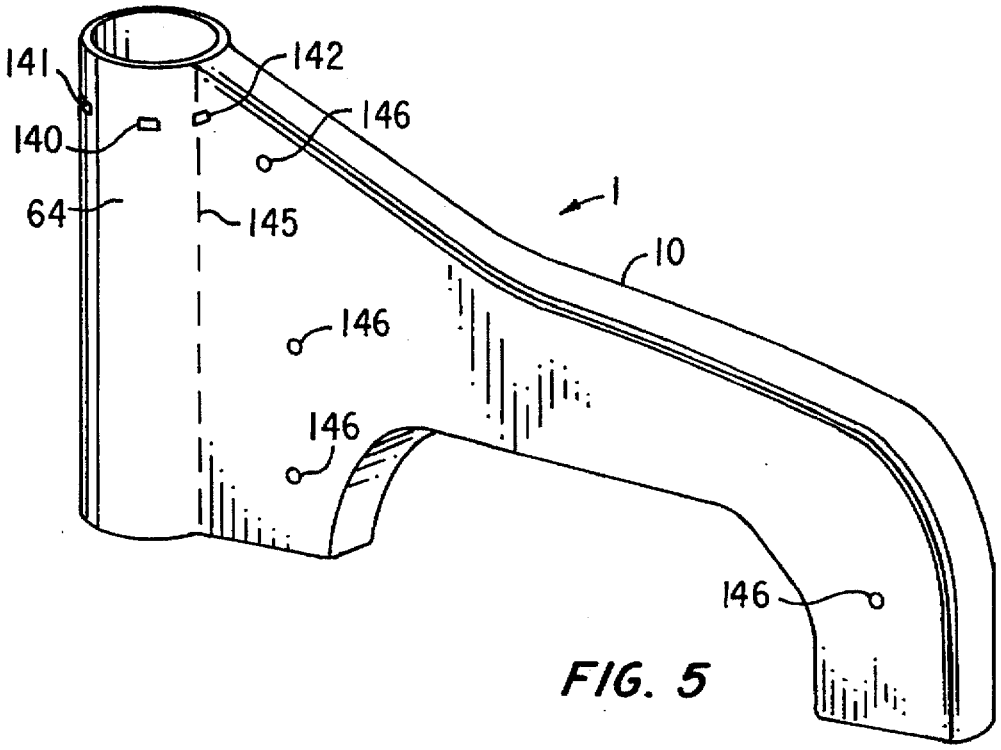

Referring to FIG. 5, a view of the top housing 10 of the staple gun 1 is illustrated. The cylindrical section 64 includes holes 140 to 142 in which tabs from the top part 60 are fit to secure the top part 60 to the housing 10. As previously mentioned, there is an aperture in the cylindrical section 64 through which the pronged end 40 of the trigger mechanism 18 fits. In accordance with a preferred embodiment of the present invention, the top housing 10 is preferably constructed of two parts that are either bolted, screwed or riveted together at points 146. Also, it is preferred to construct the each side of the top housing 10 with a single sheet of metal such that the area around the line 145 is in fact rounded off and not formed by separate pieces of metal. This structure will yield greater strength to the housing. Where the top housing 10 is constructed from two sheets of metal, it is preferred to slide a retainer sleeve 149, illustrated in FIG. 5A, over the cylindrical section 64 of the top housing 10. The retainer 149 has holes 150 that align with the screws at points 146. This allows the two part cylindrical section 64 of the top housing 10 to be secured together.

Figure 6:
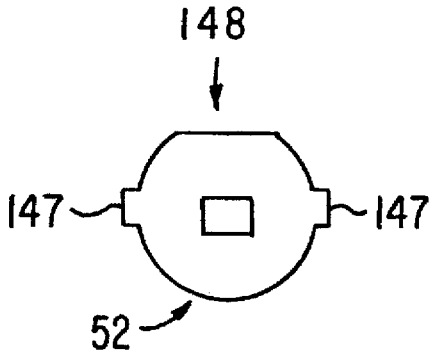
FIG. 6 illustrates a preferred embodiment of the bottom retainer of the staple gun of FIG. 1.

Referring to FIG. 6, a preferred embodiment of the bottom retainer 52 is illustrated. The bottom retainer 52 preferably includes tabs 147 which are integral parts of the retainer 52 that are used to secure the retainer 52 to the lower housing 12. Again, as many tabs as are needed to ensure a proper link between the housings 10 and 12 can be used. The retainer 52 is mainly circular to ensure a fit within the cylindrical sections of the housings 10 and 12. However, the circumference of the retainer includes a section 148 which is squared off. When the retainer 148 is positioned in the staple gun, the squared off section 148 engages the hammer portion 46 of the driver mechanism 42, thereby acting as a guide for the hammer 46. This also causes the driver mechanism 42 to turn with the lower housing 12.

Figure 7:
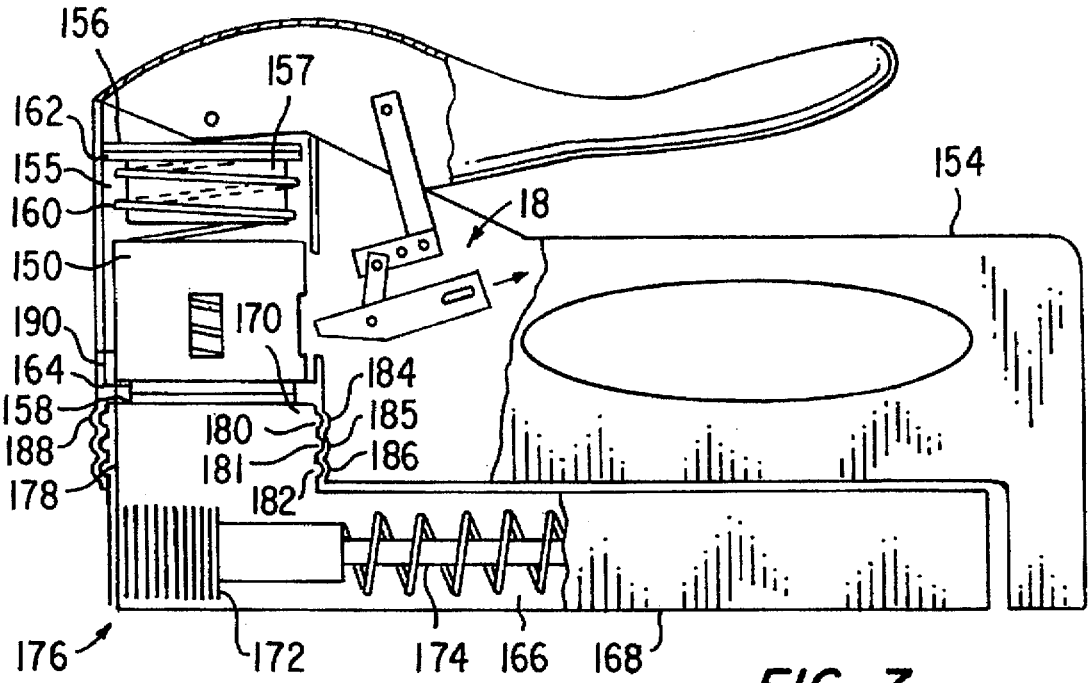
FIG. 7 illustrates a side view of a staple gun in accordance with a alternate embodiment of the present invention.
Figure 10:
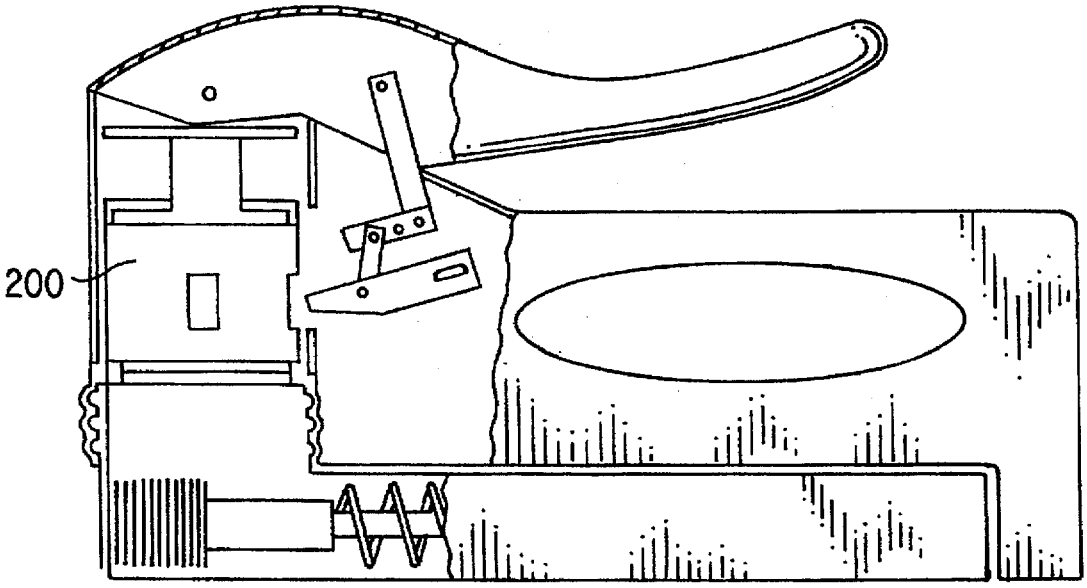
FIG. 10 illustrates a staple gun utilizing a gas driver mechanism.

Referring to FIG. 7 an alternate embodiment of the staple gun in accordance with the present invention is illustrated. In FIG. 7, a driver mechanism 150 which is similar or the same as the driver mechanism used in the staple gun 1 of FIG. 1, is positioned inside a cylindrical section 155 of a top housing 154. A top retainer 156 and a bottom retainer 158 are held in place in a cylindrical section 155 of the housing 154 by tabs. A spring 160 is held in place in between the retainers 156 and 158 and by a guide 157. It is preferred to provide shock absorbing pads 162 and 164 as illustrated.

The staple magazine 166 is preferably essentially L-shaped, including a magazine section 168 and a cylindrical section 170. The staple magazine 166 holds staples 172 in position and feeds succeeding staples into the proper position with a conventional feeding mechanism 174. An example of an appropriate spring loaded mechanism is found in the Model T-50 staple gun. The staple magazine 166 has an aperture 176 through which the staples 172 are propelled by the hammer section 178 of the driver mechanism 150 when the trigger mechanism 18 is activated.

The cylindrical section 170 of the staple magazine 166 fits inside the upper housing 154 so that the staple magazine 166 can be rotated to allow the staples to be stapled at various angles without the need to rotate the upper housing 154 of the staple gun. The cylindrical section 170 of the staple magazine 166 preferably includes ribs 180 to 182 which extend around the entire outer circumference of the section 170. The cylindrical section 155 of the housing 154 has ribs 184 to 186 which extend around the entire inner circumference of the section 48. The ribs 180 to 182 fit into the ribs 184 to 186. The upper housing 154 is preferably constructed from two pieces of metal that are either screwed or riveted together. When the two pieces of metal that form the housing are secured together, the ribbed sections hold the staple magazine 166 in place inside the housing 154 so that the staple magazine can be rotated about the housing.

In accordance with a preferred embodiment of the present invention, the cylindrical section 155 in the upper housing 154 is divided into two sections which have different inner diameters. The first section 188 houses the cylindrical section 170 from the staple magazine 166. Thus, to provide a secure and snug fit, it is preferred that the inner diameter of the first section 188 be approximately equal to or just slightly larger than the outer diameter of the cylindrical section 170 of the staple magazine 166. The second section 190 houses the driver mechanism. 150. The driver mechanism 150 must fit within the cylindrical section 170 of the staple magazine 166 and thus must have an outer diameter which is slightly less than the inner diameter of the cylindrical section 170 of the staple magazine 166. It is preferred to provide the second section 190 with a smaller inner diameter than the first section 188 in order to hold the driver mechanism 150 securely in place. Thus, the inner diameter of the second section 190 is approximately equal to or just slightly larger than the outer diameter of the driver mechanism 150.

Figure 8:
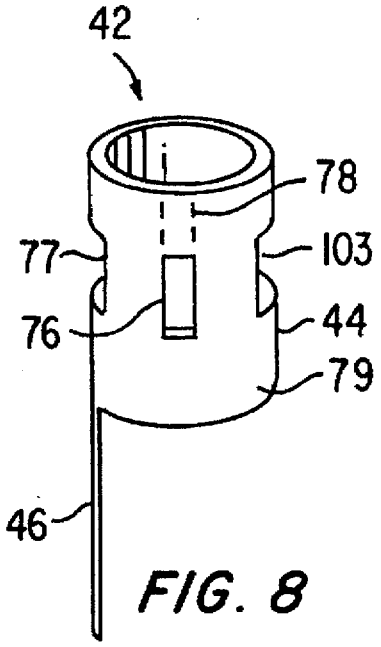
FIG. 8 illustrates a driver mechanism.

FIG. 8 illustrates the driver mechanism 42 of FIGS. 1 and 2. Three apertures 76, 77 and 103 in the cylindrical section 44 can be seen. The fourth aperture 78 is illustrated as a dotted line. The full width of the hammer section 46 is approximately equal to the width of the staples. The bottom plate 79 of the cylindrical section 44 is preferably solid or at least lipped to support the spring in the driver mechanism 42. It should be noted that the apertures can extend all the way through the cylindrical walls of the driver mechanism 42 or, alternatively, can be cut partially into the cylindrical walls.

Figure 9:
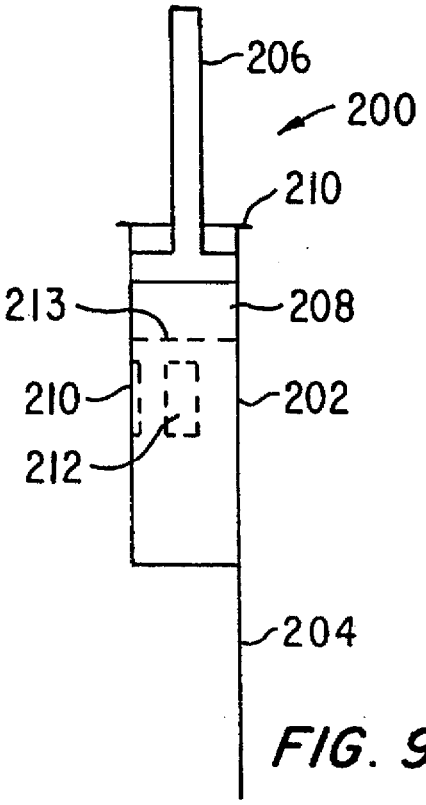
FIG. 9 shows a gas driver mechanism.

In FIG. 9, another driver mechanism 200 is illustrated. The driver mechanism 200 includes a cylindrical section 202 and a hammer section 204. The cylindrical section 202 is sealed and a piston 206 extends inside the cylindrical section 202. The section 208 below the piston 206 is filled with a gas. The cylindrical section 202 includes a plurality of apertures 210 and 212 which are partially cut into the walls of the cylindrical section 202. As will be discussed below, the apertures 210 and 212 serve the same function as the apertures did in the driver mechanism 42. In an alternate embodiment of the gas driver mechanism 200 of FIG. 5, a lip 210 can be provided around the circumference of the driver mechanism 200. In this alternate embodiment, the trigger mechanism engages the lip to lift the driver mechanism. It should be noted that the lip can be used in non-gaseous driver mechanisms as well. In FIG. 1 0, the gas driven driver mechanism 200 of FIG. 9 is illustrated in a staple gun.

Referring to FIG. 9, the gas driver 200 can be constructed in many different ways. For example, the bottom of the section 208 can be raised above the apertures 210 and 212, as indicated by the line 213, thereby allowing the apertures 210 and 212 to extend fulling through the cylindrical wall. The apertures 210 and 212 can also be moved further down on the driver 200 to allow the size of the section 208 to be increased.

It is understood that changes may be made in the above description without departing from the scope of the invention. It is accordingly intended that all matter contained in the above description and in the drawings be interpreted as illustrative rather than limiting.

What is claimed is:

1. A staple gun for implanting a staple in an object, comprising:

a driver mechanism that moves along an axis to implant the staple in the object;

a top housing having a top and a bottom section;

a spring connected to the top section of the top housing to hold the driver mechanism in place in the bottom section of the top housing;

a lower housing connected to the bottom section of the top housing so that the lower housing can be rotated about the axis that the driver mechanism moves along, the driver mechanism rotating with the lower housing; and, trigger means for initially lifting the driver mechanism against the force of the spring and then releasing the driver mechanism so that the spring forces the driver mechanism down.

2. The staple gun of claim 1, wherein the lower housing can be rotated to one of a plurality of positions relative to the top housing.

3. The staple gun of claim 2 wherein the positions are 0°, 90°, 180°, and 270° relative to the top housing.

4. The staple gun of claim 1, further comprising:

position locking means for orienting the angle of the lower housing rotation relative to the top housing.

5. The staple gun of claim 1, wherein the length of the lower housing is shorter than the length of the top housing and wherein the top housing further comprises a base section that extends downward.

6. A staple gun for implanting a staple in an object, comprising:

a driver mechanism that moves along an axis to implant the staple in the object;

a top housing that extends away from the axis a first distance; and a lower housing connected to the top housing so that the lower housing can be rotated about the axis that the driver mechanism moves along, the lower housing extending away from the axis a second distance which is shorter than the first distance, the lower housing also having a bottom; and the top housing further having a base section having a bottom, the base section extending down substantially parallel to the axis, the bottom of the base section being in planar alignment with the bottom of the lower housing.

* * * * *